US006681812B2

(12) United States Patent
Mitchell

(10) Patent No.: US 6,681,812 B2
(45) Date of Patent: Jan. 27, 2004

(54) ATTACHMENT FOR A VACUUM PUMP

(75) Inventor: David Mitchell, Queensland (AU)

(73) Assignee: ABW Australia Pty. Ltd., Darra (AU)

( * ) Notice: Subject to any disclaimer, the term of this patent is extended or adjusted under 35 U.S.C. 154(b) by 0 days.

(21) Appl. No.: 10/095,911

(22) Filed: Mar. 13, 2002

(65) Prior Publication Data

US 2002/0134458 A1 Sep. 26, 2002

(30) Foreign Application Priority Data

Mar. 21, 2001 (AU) ..... PR3878

(51) Int. Cl.[7] ..... B65B 1/04

(52) U.S. Cl. ..... 141/65; 141/301; 184/1.5; 62/292; 137/907

(58) Field of Search ..... 141/65, 59, 67, 141/301, 95; 137/907, 606; 184/1.5; 62/292

(56) References Cited

U.S. PATENT DOCUMENTS

| | | | | |
|---|---|---|---|---|
| 4,119,117 A | * | 10/1978 | Winkelvoss | 137/456 |
| 5,329,982 A | | 7/1994 | Payne | |
| 5,560,407 A | * | 10/1996 | Swinford | 141/385 |
| 5,673,733 A | | 10/1997 | Turcotte et al. | |
| 5,704,383 A | * | 1/1998 | Kammeraad et al. | 137/15.14 |
| 6,152,193 A | | 11/2000 | Klamm | |
| 6,199,578 B1 | * | 3/2001 | Clark, II | 137/318 |

FOREIGN PATENT DOCUMENTS

WO WO 01/60671 8/2001

OTHER PUBLICATIONS (One page extract) Vacufill, Vacufill Cooling System Machine, Automotive Repair Shop Equipment from Buyersgroup.com, www.buyersgroup.com/products/vacufill/vacufill (No Date).

(Four page extract) Press Release from UView, Vacufill and Airlift, www.uview.com/press_release/body_press_release (No Date).

(One page extract) Johnson Mfg. Co., Airlift Coolant Filling Kit, Airlift Coolant Service Kit, www.johnsonmfg.com/temp/j360cs (No Date).

* cited by examiner

*Primary Examiner*—Steven O. Douglas
(74) *Attorney, Agent, or Firm*—Hoffman, Wasson & Gitler, PC

(57) ABSTRACT

An attachment (3) for a vacuum gun (2), for introducing new coolant into a cooling system of a vehicle after spent coolant has been drained from the cooling system. The attachment (3) comprises: a body (4) having a first inlet (36) for air left in the cooling system of the vehicle after spent coolant has been drained from the cooling system; a second inlet (37) for the new coolant; an outlet (38); a passage (39) connecting the outlet (38) to each of the inlets (36, 37); and, a jumper valve (40) located within the passage (39). The jumper valve (40) is moveable between a first closed position and a second open position, and it is biased with a coil spring (41) to remain in the first position. Whilst a vacuum is applied to the attachment (3) by the vacuum gun (2), the jumper valve (40) is in the second position and air may be drawn from the cooling system to form a partial vacuum within the cooling system. The attachment (3) further comprises a tap (34) attached to the second inlet (37), a hose (35) extending from the tap (34) to a source of the new coolant, and a pressure gauge (33) for monitoring the pressure within the passage (39).

11 Claims, 2 Drawing Sheets

ATTACHMENT FOR A VACUUM PUMP

This invention relates to an attachment for a vacuum pump. In particular, the invention concerns an attachment for evacuating fluid from a container and for introducing new fluid into the container.

BACKGROUND OF THE INVENTION

The invention has been developed primarily for changing coolant in a cooling system of a vehicle and will therefore be described in this context. It is to be appreciated, however, that the invention may have other uses.

In order to keep a vehicle in good running order, it is important to empty the vehicle's cooling system of spent coolant and to refill the cooling system with fresh coolant.

The usual method of changing coolant entails opening various ports of the cooling system, such as a radiator cap and a stopcock, and then allowing the coolant to drain from the cooling system under gravity. After the coolant has drained, the stopcock is closed and fresh coolant is poured into the system by way of a neck of the radiator. The neck is then sealed with the radiator cap.

A disadvantage with the aforementioned method is that pockets of air may become trapped in the cooling system. This may happen even if precautions, such as running the engine for a period of time without the radiator cap in place, are taken. It is essential that all pockets of air be removed, else the vehicle's engine may overheat and suffer damage. Another disadvantage with the method is that a leak in the cooling system may go undetected.

SUMMARY OF THE INVENTION

It is an object of the present invention to provide an attachment for a vacuum pump that minimises at least one of the disadvantages referred to above, or provides the public with a useful or commercial choice.

According to the present invention there is provided an attachment for a vacuum pump, for evacuating a first fluid from a container and for introducing a second fluid into the container, said attachment having:

- a body having:
  - a first inlet for the first fluid;
  - a second inlet for the second fluid;
  - an outlet;
  - a passage connecting the outlet to each of the inlets, the outlet being attachable to the vacuum pump and the first inlet being attachable to the container; and
  - a valve within the passage adjacent the outlet, said valve being moveable between a first position in which the passage is closed and a second position in which the passage is open, the valve being biased to remain in the first position, and whilst a vacuum is applied to the attachment by the vacuum pump, the valve is in the second position and the first fluid may be drawn into the vacuum pump; and
- an operating member for regulating the flow of fluid through the second inlet.

Preferably, the attachment is attachable to the vacuum gun described in the specification of PCT/AU01/00127, the entire content of which is incorporated herein by reference. The outlet of the body may be located at the end of a nozzle, and the nozzle may be frictionally attachable to a front end of the vacuum gun. Preferably, the nozzle is further attachable with a locking member such as a lock nut.

The vacuum gun may have a deflector attached to a rear end of the gun for directing the first fluid away from the face of the person using the gun. Preferably, the deflector is a perforated plate, wherein the perforations are orientated to direct the first fluid away from the person's face.

Preferably, the valve is a jumper valve, the passage has a valve seat, and the jumper valve is biased into the first position against the valve seat. The jumper valve can be biased into the first position with a coil spring.

Preferably, the container is a cooling system of a vehicle and the first inlet is attachable to a neck of a radiator of the cooling system. The coolant within the cooling system may first be drained by opening a stopcock of the radiator. The first fluid is the air occupying the cooling system after the coolant has been drained. The second fluid is fresh coolant that is to be added to the cooling system whilst under vacuum.

The first inlet is preferably located at an end of a resilient (eg. rubber) cone that fits into the neck of the radiator. Preferably, the cone has a stepped periphery that enables attachment to radiator necks of varying diameter.

The operating member that regulates the flow of fluid through the second inlet may be a valve or a tap. Preferably, the operating member is a tap that is attached to the second inlet and a hose extends from the tap to a source of the second fluid.

Preferably, the attachment further has a pressure gauge attached to the body for monitoring the pressure within the passage. Any suitable type of pressure gauge known to persons skilled in the art may be used.

According to a preferred form of the invention, there is provided an attachment for a vacuum pump for introducing new coolant into a cooling system of a vehicle, said attachment having:

- a body having:
  - a resilient cone having an inlet for air from the cooling system of the vehicle after spent coolant has been drained from the cooling system;
  - an inlet for the new coolant;
  - a nozzle having an outlet;
  - a passage connecting the outlet to each of the inlets, the nozzle being attachable to the vacuum pump and the cone being attachable to a neck of a radiator of the cooling system; and
  - a jumper valve located within the passage adjacent the outlet, said jumper valve being moveable between a first position in which the passage is closed and a second position in which the passage is open, the jumper valve being biased into the first position and movable into the second position when a vacuum is applied to the attachment by the vacuum pump, and when the jumper valve is in the second position, air may be drawn from the cooling system to form a partial vacuum therein;
- a tap attached to the inlet for the new coolant and new coolant may be introduced into the cooling system when the system is under vacuum and when the tap is opened;
- a hose extending from the tap to a source of the new coolant; and
- a pressure gauge attached to the body for monitoring the pressure within the passage.

BRIEF DESCRIPTION OF THE DRAWINGS

A preferred embodiment of the invention will now be described by way of reference to the accompanying drawings in which.

DETAILED DESCRIPTION OF THE PREFERRED EMBODIMENT

Figure 1:
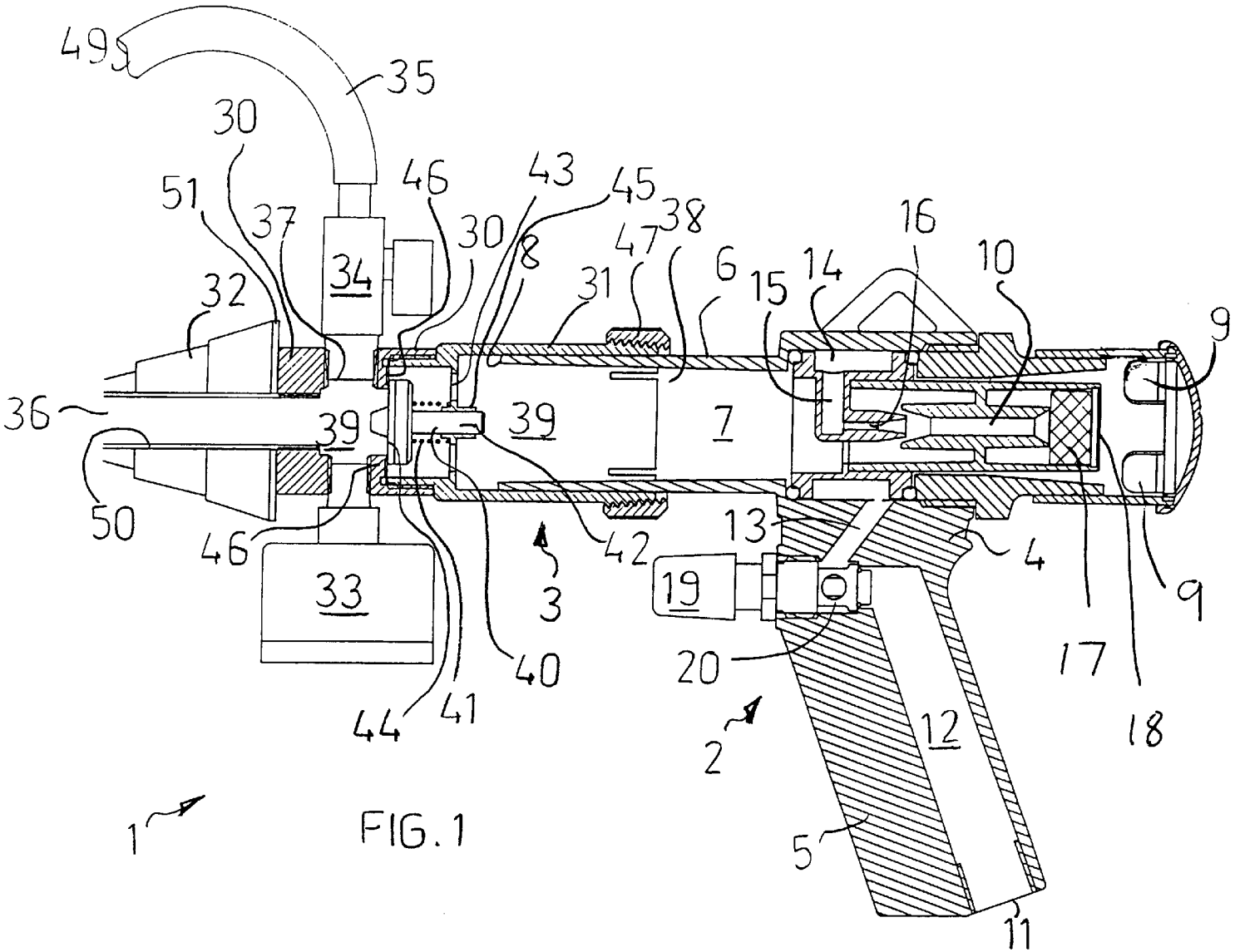
FIG. 1 is a partially sectioned elevational view of a vacuum gun assembly having a gun and an attachment for the gun, according to an embodiment of the invention.

In all of the drawings, like reference numerals refer to like parts.

Referring first to FIG. 1, there is shown a vacuum gun assembly 1 comprising a vacuum gun 2 and an attachment 3 for the gun 2. The gun assembly 1 will be described by way of example with reference to use in forming a partial vacuum in a coolant system of a vehicle and for refilling the system with fresh coolant.

The gun 2 has a body 4 of the type disclosed in the specification of PCT/AU01/00127 and has a grip 5, a barrel 6 and a bore 7 extending from a front end 8 to a rear end 9 of the gun 2.

The gun 2 has a venturi motor 10 within the bore 7 which, in this example, is powered by compressed air that feeds into the body 4 through inlet 11 and flows to the motor 10, after which the air is discharged at the rear end of the gun 2. To reach the motor 10, air flows from inlet 11 to passage 12 to passage 13 to annular space 14 to passage 15 and to motor inlet 16.

The discharge end of the motor 10 contains a foam insert 17 and is covered with a perforated plate 18, both of which are directly in the path of the air stream. Insert 17 and plate 18 serve to reduce the noise caused by the air prior to discharge, and the perforations 9 serve to direct the discharged fluid away from the user's face.

A spring-loaded button 19, operatively connected to a moveable valve 20, controls the supply of air to the venturi motor 10. The valve 20 inhibits the flow of air to the motor 10 when the button 19 has not been depressed.

Figure 2:
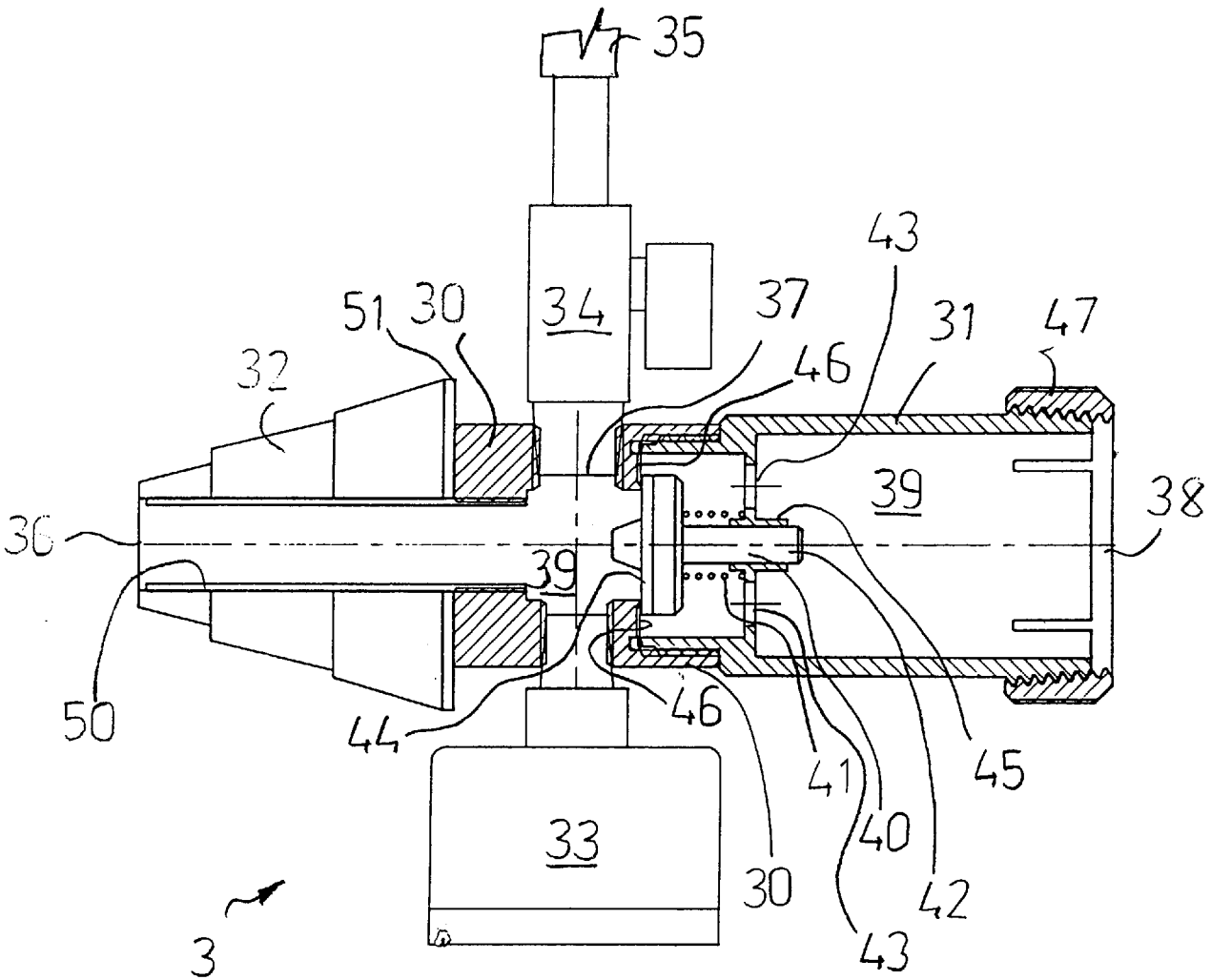
FIG. 2 is a partially sectioned elevational view of the attachment of the gun assembly of FIG. 1.

Referring now to either FIG. 1 or FIG. 2, the attachment 3 has a body comprising body member 30, a nozzle 31 that is coupled to body member 30, a pipe 50 that extends from body member 30, and a rubber cone 32 that is fixed to pipe 50 and separated from body member 30 with a washer 51.

The attachment 3 also has a pressure gauge 33 and a tap 34 attached to body member 30. A hose 35 extends from the tap 34.

Rubber cone 32 has a first inlet 36. Body member 30 has a second inlet 37 to which is attached the tap 34. Nozzle 31 has an outlet 38 and a forked passage 39 extends between the outlet 38 and inlets 36, 37. A sprung jumper valve 40 is located within the passage 39 adjacent the outlet 38.

The nozzle 31 has a plurality of stays 43 that support a collar 45 within the passage 39. The jumper valve 40 has a stem 42 that may slide within the collar 45. A wall of the passage 39 is fashioned as a valve seat 46. A coil spring 41 biases a sealing portion 44 of the jumper valve 40 into the valve seat 46. The jumper valve 40 may move between a first position in which the passage 39 is blocked and a second position in which the passage 39 is open and fluid may flow from inlet 36 to outlet 38.

In use, a source of compressed air is connected to inlet 11 of the grip 4 and the nozzle 31 is secured over the barrel 6 of the gun 2 with a threaded locking nut 47. The rubber cone 32 is pressed into a neck of the radiator (not shown). The stepped periphery of the cone 32 enables the attachment 3 to be used with radiator necks of varying diameter.

After coolant has been drained from the coolant system, tap 34 is closed and button 19 is depressed. This results in the formation of a partial vacuum in the coolant system by drawing air from the system through inlet 36, between valve seat 46 and jumper valve 40, between stays 43, through outlet 38, finally to be discharged through the perforations 9 at the rear of the gun 2. Perforations 9 ensure that the air and any other fluids drawn through the gun are directed away from the face of the gun user.

After a partial vacuum is formed in the cooling system, button 19 is released, the jumper valve 40 seals against the valve seat 46 and the cooling system is left under negative pressure. The pressure within the cooling system is monitored with the pressure gauge 33 for leaks.

Prior to filling the cooling system with fresh coolant, the hose 35 is primed with fresh coolant. End 49 of hose 35 is placed into a container of fresh coolant, button 19 is pressed and tap 34 is opened slightly so that the air within the hose 35 may be evacuated and replaced with fresh coolant. The air in the hose 35 may otherwise cause an airlock in the cooling system. After the hose 35 has been primed with fresh coolant, button 19 is released, the jumper valve 40 moves to close the passage 39, and the negative pressure within the cooling system draws fresh coolant through inlets 34 and 36 into the radiator. The pressure within the cooling system is monitored with the pressure gauge 33.

After the cooling system has been filled with fresh coolant, the rubber cone 32 is removed from the neck of the radiator and the neck is sealed with a cap.

In this way, the attachment 3 may be used to change the coolant without introducing an airlock and the cooling system may be checked for leaks.

What is claimed is:

1. An attachment for a vacuum pump, for evacuating a first fluid from a container and for introducing a second fluid into the container, said attachment having:

a body having:

a first inlet for the first fluid;

a second inlet for the second fluid;

an outlet;

a passage connecting the outlet to each of the inlets, the outlet being attachable to the vacuum pump and the first inlet being attachable to the container; and a valve within the passage adjacent the outlet, said valve being moveable between a first position in which the passage is closed and a second position in which the passage is open, the valve being biased to remain in the first position, and whilst a vacuum is applied to the attachment by the vacuum pump, the valve is in the second position and the first fluid may be drawn into the vacuum pump; and an operating member for regulating the flow of fluid through the second inlet.

2. The attachment of claim 1, wherein the valve is a jumper valve, the passage has a valve seat, and the jumper valve is biased into the first position against the valve seat.

3. The attachment of claim 1, wherein the outlet of the body is located at the end of a nozzle that is attachable to the vacuum pump.

4. The attachment of claim 3, wherein the nozzle is frictionally attachable to the vacuum pump.

5. The attachment of claim 1, wherein the first inlet is located at an end of a resilient cone having a stepped periphery.

6. The attachment of claim 1, wherein the operating member is a tap.

7. The attachment of claim 6 further having a hose extending from the tap.

8. The attachment of claim 1 further having a pressure gauge attached to the body for monitoring the pressure within the passage.

9. The attachment of claim 1, wherein the container is a cooling system of a vehicle, the first inlet is attachable to a neck of a radiator of the cooling system, the first fluid is air occupying the cooling system after the spent coolant has been drained from the cooling system, and the second fluid is fresh coolant that is to be introduced to the cooling system whilst the cooling system is under vacuum.

10. The attachment of claim 1, wherein the first and second fluids are dissimilar fluids, the first fluid comprising air and the second fluid comprising fresh coolant.

11. An attachment for a vacuum pump for introducing new coolant into a cooling system of a vehicle, said attachment having:

a body having:

a resilient cone having an inlet for air from the cooling system of the vehicle after spent coolant has been drained from the cooling system;

an inlet for the new coolant;

a nozzle having an outlet;

a passage connecting the outlet to each of the inlets, the nozzle being attachable to the vacuum pump and the cone being attachable to a neck of a radiator of the cooling system; and a jumper valve located within the passage adjacent the outlet, said jumper valve being moveable between a first position in which the passage is closed and a second position in which the passage is open, the jumper valve being biased into the first position and movable into the second position when a vacuum is applied to the attachment by the vacuum pump, and when the jumper valve is in the second position, air may be drawn from the cooling system to form a partial vacuum therein;

a tap attached to the inlet for the new coolant and new coolant may be introduced into the cooling system when the system is under vacuum and when the tap is opened;

a hose extending from the tap to a source of the new coolant; and a pressure gauge attached to the body for monitoring the pressure within the passage.

* * * * *